US005200036A

United States Patent [19]

Noda

[11] Patent Number: 5,200,036

[45] Date of Patent: Apr. 6, 1993

[54] PAPER WITH POLYCATIONIC LATEX STRENGTH AGENT

[75] Inventor: Isao Noda, Fairfield, Ohio

[73] Assignee: The Procter & Gamble Company, Cincinnati, Ohio

[21] Appl. No.: 802,022

[22] Filed: Dec. 3, 1991

Related U.S. Application Data

[63] Continuation of Ser. No. 516,410, Apr. 30, 1990, abandoned.

[51] Int. Cl.[5] ..... D21H 17/46

[52] U.S. Cl. ..... 162/164.3; 162/146; 162/164.6; 162/168.1; 162/168.2; 162/168.5

[58] Field of Search ..... 162/164.3, 169, 164.6, 162/168.2, 168.1, 146, 168.5

[56] References Cited

U.S. PATENT DOCUMENTS

| | | | |
|---|---|---|---|
| 2,745,744 | 5/1956 | Weidner et al. | 162/168 |
| 3,338,858 | 8/1967 | Strasser et al. | 162/164.3 |
| 3,556,932 | 1/1971 | Coscia et al. | 162/166 |
| 3,556,933 | 1/1971 | Williams et al. | 162/167 |
| 3,700,623 | 10/1972 | Keim | 260/80.3 |
| 3,772,076 | 11/1973 | Keim | 117/155 |
| 3,926,890 | 12/1975 | Huang et al. | 260/29.6 |
| 4,121,966 | 10/1978 | Amano et al. | 162/164 |
| 4,189,345 | 2/1980 | Foster et al. | 162/168 |
| 4,785,030 | 11/1988 | Noda et al. | 523/201 |
| 4,835,211 | 5/1989 | Noda et al. | 524/762 |

FOREIGN PATENT DOCUMENTS 33988 8/1981 European Pat. Off. .

*Primary Examiner*—Peter Chin
*Attorney, Agent, or Firm*—Jerry J. Yetter

[57] ABSTRACT

Polycationic wet strength agents such as KYMENE are chemically modified and cross-linked into and onto the surface of latex particles. Paper treated with the resulting polycationic latex particles exhibits enhanced wet strength. Thus, KYMENE is reacted, for example, with acrylic acid and cross-linked with styrene/butadiene to provide a polycationic latex which is used to treat paper. Paper sheets, bags, containers and the like are provided. Also provided are paper towels, and the like, having super-absorbent materials incorporated therein.

3 Claims, No Drawings

PAPER WITH POLYCATIONIC LATEX STRENGTH AGENT

This is a continuation of application Ser. No. 516,410, filed on Apr. 30, 1990, now abandoned.

TECHNICAL FIELD

The present invention relates to paper treated with latex compositions having polycationic surface substituents. The resulting paper sheets exhibit enhanced wet-strength. Polyanionic additives, such as absorbent gelling materials, can be present in the paper without undesirable interactions with said polycationic latexes.

BACKGROUND OF THE INVENTION

Water-soluble cationic resins are often used as wet-strength additives in papermaking. One widely used type of wet-strength resin is the polyamide/-polyamine/epichlorohydrin material sold under the trade name KYMENE. See, for example, U.S. Pat. No. 3,700,623 to Keim, issued Oct. 24, 1972; and U.S. Pat. No. 3,772,076 to Keim, issued Nov. 13, 1973. Another group of water-soluble cationic wet-strength resins are the polyacrylamides sold under the trade name PAREZ. See, for example, U.S. Pat. No. 3,556,932 to Coscia et al, issued Jan. 19, 1971; and U.S. Pat. No. 3,556,933 to Williams et al, issued Jan. 19, 1971.

The cellulosic fibers used in papermaking are negatively charged. Since the water-soluble wet-strength resins are cationic (positively charged), they are deposited and retained well when directly added to the aqueous pulp slurry. Such "wet-end addition" is highly desirable in papermaking. Subsequently in the papermaking process, these resins cross-link and eventually become insoluble in water. When this occurs, the wet-strength resin acts as a "glue" to hold the fibers of the paper together. This results in the desired wet-strength property.

Paper products made with such resins often have a stiff, paper-like feel. To impart greater softness to the paper product, styrene-butadiene latexes can be used as the binder system. However, these styrene-butadiene latexes are usually either nonionic in character or else are partially anionic due to inclusion of anionic comonomers or surfactants. The nonionic styrene-butadiene latexes cannot be used as "wet-end additives" in a conventional papermaking process. Instead, these nonionic latexes have to be impregnated or pattern-printed on the subsequently laid paper furnish, such as by the process described in European Patent application 33,988 to Graves et al, published Aug. 19, 1981.

An anionic styrene-butadiene latex can be used in a conventional wet-end additive papermaking process by adding a cationic polyelectrolyte. See, for example, U.S. Pat. No. 4,121,966 to Amano et al, issued Oct. 24, 1978; and U.S. Pat. No. 2,745,744 to Weidner et al, issued May 15, 1956. The cationic polyelectrolyte used is typically a water-soluble cationic wet-strength resin. Basically, the cationic polyelectrolyte, when added, destabilizes the dispersed anionic latex particles which then flocculate and deposit on the paper fibers. Accordingly, the cationic polyelectrolyte and anionic styrene-butadiene latex cannot be combined together until the point at which they are used as the binder system in papermaking.

Styrene-butadiene latexes have also been modified to provide cationic groups chemically bound on the surface of the latex particles. See, for example, U.S. Pat. No. 4,189,345 to Foster et al, issued Feb. 19, 1980; and U.S. Pat. No. 3,926,890 to Huang et al, issued Dec. 16, 1975. Incorporation of the cationic groups on the surface of the latex particles converts the latex into a wet-end additive like the water-soluble cationic wet-strength resins. These cationic latexes appear to have adequate colloidal stability, especially when nonionic or preferably cationic surfactants are added. However, the deposition and retention of the cationic latex particles on the paper fibers does not appear to be very great. Indeed, the cationic latex of the Foster et al patent appears to require a co-additive to enhance the deposition of the latex particles on the paper fibers.

Accordingly, a cationic latex which combines: (1) colloidal stability; (2) enhanced deposition and retention of the latex particles on the paper fibers; and (3) enhanced wet-strength properties, would be highly desirable.

The polycationic latexes of this invention provide these desirable benefits.

Despite the various art-described attempts to improve wet-strength resins, the wet-strength resin of choice has remained the polycationic material, KYMENE. Unfortunately, as noted hereinabove, the use of excessive amounts of KYMENE can cause paper treated therewith to become not only stronger, but also stiffer, which is undesirable for some uses. Stated otherwise, KYMENE not only enhances the wet tensile strength of the paper, but also increases its dry tensile strength, thereby leading to a stiff or brittle feel. This is undesirable in situations where paper with a soft, more cloth-like feel is desired.

Moreover, it has now been determined that KYMENE-type polycationic water-soluble wet-strength resins can undesirably interact with anionic additives which the formulator may wish to incorporate into the paper. For example, various anionic superabsorbent materials have their absorbency undesirably lessened when KYMENE is present.

In the present invention, it has been discovered that KYMENE-type wet-strength resins can be effectively rendered water-insoluble, and thus rendered less reactive to anionic paper additives. Moreover, it has been discovered that the polycationic latexes of the present invention desirably enhance the wet-strength of paper treated therewith, but without causing the paper to have an undesirable stiff feel. In addition, the maximum wet strength obtained with KYMENE seems to peak at about 150 g/in (for Northern Softwood Kraft handsheets) whereas the polycationic latexes herein can yield wet strengths as high as 1200 g/in. These and other advantages of the present invention will be appreciated from the disclosure hereinafter.

BACKGROUND ART

U.S. Pat. Nos. 4,785,030 and 4,835,211 to Noda and Hager, issued Nov. 15, 1988 and May 30, 1989, respectively, describe cationic latexes which impart a soft feel to paper.

U.S. Pat. No. 4,189,345 to Foster et al, issued Feb. 19, 1980, describes a fibrous product containing papermaking pulp, a structured-particle latex having pH independent cationic groups bound at or near the particle surface and a co-additive. The structured-particle latex has a copolymer core of styrene and butadiene, and an encapsulating layer of styrene, butadiene and vinylbenzyl chloride which is reacted with 2-(dimethyl amino) ethanol to form quaternary ammonium groups. The co-additive can be a hydrolyzed polyacrylamide having a degree of polymerization of 5500 and is used to enhance deposition of the cationic latex on the pulp fibers. In making the fibrous product, the structure-particle latex and an aqueous solution of the co-additive are added to an aqueous slurry of the pulp, which is then dewatered and dried by heating.

U.S. Pat. No. 3,926,890 to Huang et al, issued Dec. 16, 1975, discloses a process for preparing a "stable" cationic latex which is described as having "excellent adsorption" (only about 69% absorption of latex based on Example 5) onto substrates such as pulp, paper and the like. The Haung et al cationic latexes are prepared by emulsion polymerization of a haloalkyl ester of acrylic or methylcrylic acid with another monosaturated compound and/or a conjugated diene compound (e.g., butadiene) in the presence of a nonionic or preferably cationic surface active agent, and then reacting a basic nitrogen-containing compound with this copolymer to form the respective ammonium salt.

U.S. Pat. No. 4,121,966 to Amano et al, issued Oct. 24, 1978, discloses a method for producing a fibrous sheet bonded with a latex flocculate. In this method, zinc white powders are added to a carboxy modified anionic latex. The pH of this mixture is adjusted to not less than 7, and then a water-soluble cationic polymer is added to obtain a latex flocculate. The latex flocculate is added to a fiber slurry which is formed into a sheet by a conventional papermaking process. Representative carboxy modified latexes include styrene-butadiene copolymers. Suitable water-soluble cationic polymers include polyamide-polyamine-epichlorohydrin resins, polyethylene imine resins, cationic modified melamine-formalin resins, and cationic modified ureaformalin resins.

U.S. Pat. No. 2,745,744 to Weidner et al, issued May 15, 1956, discloses a method for incorporating polymeric or rubberlike materials into cellulosic fibers used to make paper. In this method, a colloidal dispersion of a hydrophobic polymer, such as a butadiene-styrene latex, is mixed with a paper pulp suspended in water. A poly-N-basic organic compound is then added to this mixture to cause particles of the colloidal dispersed material to adhere to the cellulosic fibers in the water suspension. The treated fiber is then formed into paper by conventional techniques.

SUMMARY OF THE INVENTION

The present invention encompasses paper sheets, or the like, comprising multiple cellulosic fibers and a wet-strength agent which comprises a water-insoluble latex composition comprising the reaction product of a cationic polyamide/polyamine/epichlorohydrin wet-strength resin and a reactant (electrophiles or nucleophiles can be used) comprising an unsaturated polymerizable hydrocarbon moiety, said reaction product being co-polymerized with latex-forming polymerizable monomers or oligomers. Typical sheets herein are those wherein the latex-forming polymerizable monomers or oligomers in said wet-strength agent are selected from the group consisting of styrene, 1,3-butadiene, isoprene, propylene, and ethylene, and mixtures thereof. Paper bags, boxes, or the like prepared from such paper exhibit excellent wet strength.

Preferred sheets herein are those wherein said wet-strength agent comprises the reaction product of a wet strength resin containing repeat units of the general structural type

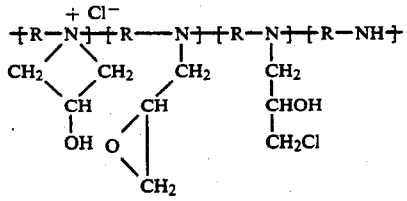

wherein R is

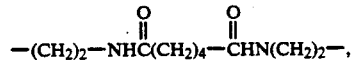

and a carboxylate reactant, said reaction product being co-polymerized with latex-forming polymerizable monomers or oligomers. Preferred sheets are those wherein said carboxylate (or carboxylate-derived) reactant is a member selected from the group consisting of acrylates, methacrylates, itaconates, vinyl benzoates, unsaturated epoxides such as glycidyl methacrylate, unsaturated chlorohydrins such as chlorohydrin methacrylate and unsaturated fatty acids and their reactive derivatives, e.g., acid halides and acid anhydrides, and mixtures thereof. Highly preferred sheets are those wherein said latex-forming polymers or oligomers are selected from the group consisting of styrene, 1,3-butadiene, isoprene, propylene, ethylene, and mixtures thereof. Vinyl acetate, methyl acrylate, methyl methacrylate and t-butyl acrylate can also be used.

Highly preferred sheets prepared according to this invention are those wherein said wet-strength agent comprises the reaction product of said cationic wet-strength resin and a carboxylate reactant selected from acrylic acid, methacrylic acid, glycidyl methacrylate, and mixtures thereof, said reaction product being co-polymerized with styrene, 1,3-butadiene or mixtures thereof.

Typically, sheets according to this invention comprise from about 1% to about 30% of said wet-strength agent by weight of said paper sheet.

This invention also encompasses paper sheets, or the like, comprising cellulosic fibers and absorbent gelling material ("AGM"), said sheets also comprising a wet-strength agent which comprises a water-insoluble latex composition comprising the above-noted reaction product of a cationic polyamide/polyamine/epichlorohydrin wet-strength resin and a reactant comprising the above-noted unsaturated polymerizable hydrocarbon moiety, said reaction product being co-polymerized with the above-noted latex-forming polymerizable monomers or oligomers. Such sheets typically comprise as said absorbent gelling material a member selected from the group consisting of polyacrylate-, starch acrylate- and acrylate grafted fiber-type materials, typically at levels of 0.5% to 50% by weight of said sheets. The sheets can be in either "layered" (laminate) form or "mixed" form as disclosed hereinafter.

The invention also encompasses a method for preparing a highly absorbent sheet of paper, or the like, comprising admixing cellulosic fibers with the above-noted latex wet-strength agent under conditions which affix said latex to said fibers, adding an absorbent gelling material to said mixture, and drying said mixture to form a sheet.

All percentages, ratios and proportions herein are by weight, unless otherwise specified.

DETAILED DESCRIPTION

The present invention relates to the manufacture of paper-type sheets. Various paper manufacturing processes have been described in great detail in patents and other literature. It is to be understood that this invention herein relates to the use of a particular type of wet-strength enhancing agent in the manufacture of various paper-type products.

I. Wet-Strength Agent—The polyamide/-polyamine/epichlorohydrin wet-strength resins employed to prepare the wet-strength agents used herein are fully described by Carr, Doane, Hamerstrand and Hofreiter, in an article appearing in the Journal of Applied Polymer Science Vol. 17, pp 721–735 (1973). Such resins are available as KYMENE (e.g., KYMENE 557) from Hercules, Inc. A commercial synthesis of such resins from adipic acid, diethylene triamine and epichlorohydrin is described in the Carr et al publication, ibid., and is U.S. Pat. No. 2,926,154 (Feb. 23, 1960) to G. I. Keim. Reference can be made to these publications for further details regarding the preparation of polyamide/-polyamine/epichlorohydrin resins of the type employed to prepare the polycationic latexes herein.

For use herein, the aforesaid resin is reacted in such a way as to introduce a polymerizable hydrocarbon moiety into the resin's structure. Such moiety can be co-polymerized with other polymerizable latex-forming monomers or oligomers to form a latex incorporating the resin. The resulting latex is polycationic, by virtue of the presence of the resin's polycationic substituents.

While not intending to be bound by theory, it is reasonable to speculate that the overall reaction involves the following, wherein M-X is a reactant comprising a reactive group X which can be, for example, carboxylate (preferred), amine, alkyl halide, chlorohydrin, epoxide, xanthate, acid anhydride, or the like, and wherein M contains at least one —C=C— bond, typically a $C_2$–$C_{16}$ unsaturated hydrocarbyl group, preferably $C_2$–$C_6$. Examples include: acrylate, methacrylate, vinyl benzoate or other vinyl group, unsaturated fatty acids and derivatives thereof, and the like. The reaction is speculated to occur at the 4-membered ring of KYMENE (i.e., schematically illustrated by the following) or at the secondary amine:

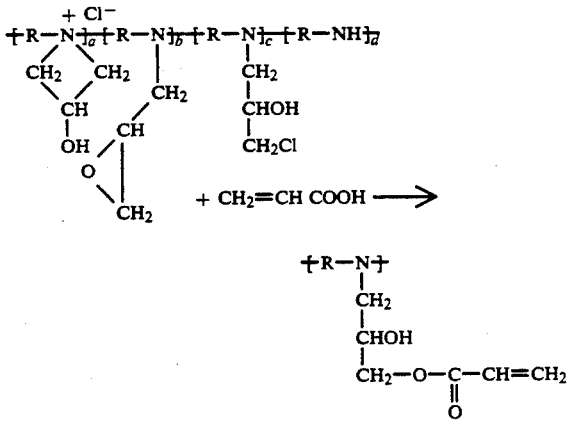

wherein a, b, c and d are each integers typically in the range of 20–500 and R is as disclosed hereinabove. Alternatively, the OH moieties and/or the residual secondary amine of KYMENE are available as reaction sites. As an example, acryloyl chloride could react with KYMENE to produce the structure below:

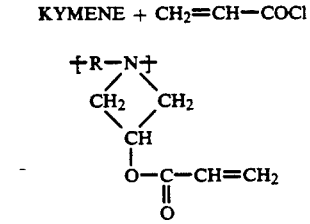

and glycidyl methacrylate could react with KYMENE to produce the structure below:

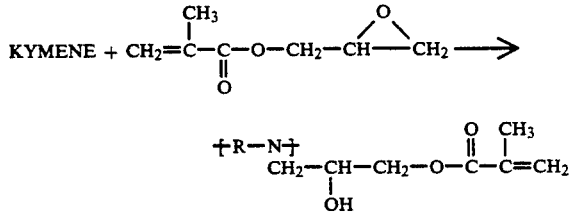

Whatever the mechanism of reaction, the unsaturated hydrocarbon moiety is thus attached to the KYMENE and is available to react with various latex-forming monomers or oligomers, thereby incorporating the KYMENE into and onto the resulting latex particles.

To illustrate the reaction further, KYMENE can be reacted with a member selected from the group consisting of vinyl benzoic acid, itaconic acid, oleic acid, linoleic acid, 3-bromopropyl acrylate, dimethylaminopropyl acrylate, acrylolyl chloride, itaconic anhydride, the methyl ester of acrylic acid, and mixtures thereof, and the reaction product co-polymerized with a member selected from the group consisting of styrene, 1,3-butadiene, isoprene, propylene, ethylene, methyl acrylate, vinyl acetate, methyl methacrylate, t-butyl methacrylate, and mixtures thereof, to provide polycationic latexes.

While the Examples disclosed hereinafter provide more specific details, the following general principles for carrying out such reactions are provided for assistance to the formulator. The reactions are conveniently carried out in water. The reaction temperatures can be in the range of about 30° C. to about 100° C., but a 60° C. reaction temperature is convenient. Reaction times can vary according to the temperature selected but reaction at 60° C. for 40 hours is convenient for laboratory syntheses. An emulsifier, e.g., oleyl ethoxylate as VOLPO-20 (Croda, Inc.), can be used in the reaction mixture, and some of this may be co-polymerized into the latex. In any event, the presence of the emulsifier results in a desirably fine suspension of the latex particles in the reaction medium. On a laboratory scale, it is convenient to use sufficient materials to provide a solids content of the final latex suspension in the range from about 10% to about 25% (wt.).

The latex compositions prepared according to such procedures are in the form of particles having an average size (sieve analysis) in the range of from about 10 nm to about 500 nm or to about several microns, preferably about 50 nm to about 500 nm. Such particles are conveniently formed as aqueous dispersions by the procedures disclosed hereinafter. The resulting dispersions can be used directly to treat paper to prepare the paper backsheets used in the practice of this invention. The following Examples illustrate the preparation of the polycationic latexes, but are not intended to be limiting thereof.

EXAMPLE I

KYMEME/Acrylic Acid/Styrene/Butadiene Latex

| Reagents | Amount (grams) |
|---|---|
| VOLPO-20 | 0.322 |
| V-50* | 0.072 |
| KYMENE** | 0.722 |
| Acrylic Acid | 0.14 |
| Styrene | 2.86 |
| 1,3-Butadiene | 4.29 |
| Distilled water as reaction medium | 50 mls |

*V-50 initiator is 2,2' azobis(2-amidopropane) dihydrochloride available from WAKO, USA.
**As 5.5 g. of 13% solution.

The water reaction medium is sparged for 30 minutes with argon prior to use. A 250 ml glass reaction bottle equipped with a magnetic stir bar is flushed with nitrogen for 5 minutes. The KYMENE, VOLPO-20, V-50 initiator and distilled water are placed in the reaction bottle, which is sealed with a rubber gasket and two-holed bottle cap. The mixture is argon sparged for 30 minutes. The acrylic acid is added using a syringe and the styrene is added using a syringe. The reaction bottle is placed in an ice bath. The 1,3-butadiene is condensed in dry ice. Using a double-ended syringe and argon pressure, the 1,3-butadiene is added to the reaction vessel. A rubber septum is wired in place over the bottle cap and the reaction bottle is placed in an oil bath at 60° C. for 40 hours, with slow stirring. At the end of this time, the reaction product is pulled and strained through a fine wire sieve to provide a suspension of a captioned latex at a solids content of 13.5%.

EXAMPLE II

The reaction of Example I is repeated under the same conditions, but using 0.722 g of KYMENE and 0.358 g of acrylic acid. The reaction product is a 12.8% polycationic latex suspension.

EXAMPLE III

The reaction of Example I is repeated, but with the amount of KYMENE increased to 1.44 g (11.1 g of 13% solution). The reaction product is a 11.5% solids suspension of polycationic latex. In an alternative mode, the KYMENE level can be decreased to 2.77 g of a 13% (wt.) KYMENE solution to provide a polycationic latex suspension (13.6% wt. solids).

EXAMPLE IV

Following the procedure of Example I, a polycationic latex is prepared, but with the substitution of methacrylic acid (0.14 g) for the acrylic acid used in Example I, and with the use of 0.722 g of KYMENE. The reaction is allowed to proceed for 26 hours at 60° C. The reaction product is an aqueous suspension of a polycationic latex.

EXAMPLE V

Following the procedure of Example I, a polycationic latex is prepared, but with the substitution of 0.14 g of glycidyl methacrylate for the acrylic acid used in Example I. The reaction product is an aqueous suspension of the polycationic latex.

EXAMPLE VI

Preparation of a Handsheet 2.65 g (2.50 g dry wt.) unrefined Northern Softwood Kraft (NSK) pulp is dispersed in 500 ml tap water at ambient pH (ca. 7.5).

5.0% (0.984 g) of the polycationic latex of Example I is added to the pulp slurry and stirred for 30 minutes.

The handsheet is made on a standard Deckle Box using tap water at ambient pH (ca. 7.5) and dried on a drum dryer at 110°-115° C.

EXAMPLE VII

The applicability of a polycationic latex as a wet-strength additive for a continuous papermaking process is as follows. Approximately 220 kg (dry weight) of refined northern softwood Kraft pulp is dispersed in water at the consistency of about 2.5% and kept in a stirred holding tank. About 400 liters of cationic latex prepared according to Example I are added to the pulp to achieve the wet-end deposition of the binder.

The latex-treated pulp is then fed to a pilot scale paper machine (equipped with normal papermaking process components, such as headbox, forming wire, and continuous dryer) at a rate of about 80 l/min. The paper machine is operated at the production speed of 200 m/min.

The latex content of the final paper products can be measured by x-ray fluorescence analysis. The analysis is done by brominating the unsaturated double bonds of a styrene-butadiene rubber component of the latex and then measuring the x-ray fluorescence intensity. The extimated latex add-on level for the sample measured by this method is on the order of 11-12%. The wet strength of the latex-containing paper product produced by a continuous pilot paper machine can be determined by measuring the tensile strength required to tear a one-inch-wide strip of paper product after the sample is soaked in water.

II. Compositions and Processes Employing Wet-Strength Agent and Polyanionic Materials—As disclosed hereinabove, the polycationic latex wet-strength agents herein can be used in paper articles, and the like, which contain various anionic materials, especially super-sorbents, without undesirably interfering with the properties of said anionic materials.

Super-absorbent materials (also referred to as "absorbent gelling materials" or "super-sorbers") which can be used in combination with the polycationic latexes herein comprise, by way of example but not limitation, the class of acrylate and starchacrylate materials which have become widely known for use in disposable diapers. Such materials are commercially available in powdered form under several trade names, such as SANWET, AQUALIC, FAVOR and ARASORB. Further details regarding such materials are available from trade literature and U.S. Pat. No. 4,610,678.

Polyanionic super-absorbents can also be prepared in fibrous form, and super-absorbent fibers are especially useful when preparing paper sheets with high water absorption capacities. Super-absorbent fibers are not as readily available in commerce as the powder-form materials noted above; accordingly, the following disclosure describes representative syntheses of such fibers.

One example of a polyanionic, chemically modified fiber having high absorbent properties comprises, chemically bonded together, (a) a cellulosic fiber, very preferably a Kraft or chemithermomechanical fiber; (b) a poly(acrylate-co-itaconate) copolymer, preferably having a relatively high acrylate content and a relatively low itaconate content; and (c) a polyol, very preferably a polyethylene glycol.

Another example of a polyanionic, chemically modified fiber having a water absorbency and retention value in the range from about 15 g/g to about 100 g/g comprises, chemically bonded together:

(a) a cellulosic fiber selected from the group consisting of chemithermomechanical pulp fiber, bleached hardwood Kraft pulp fiber, bleached softwood Kraft pulp fiber, unbleached hardwood Kraft pulp fiber, unbleached softwood Kraft pulp fiber, bleached softwood sulfite pulp fiber, bleached hardwood sulfite pulp fiber, unbleached softwood sulfite pulp fiber, unbleached hardwood sulfite pulp fiber, cotton linters, mercerized dissolving pulp fiber, unmercerized dissolving pulp fiber, and mixtures thereof;

(b) a poly(methyl vinyl ether-co-maleate) 1:1 copolymer having a number average molecular weight in the range from about 39,000 to about 80,000, and (c) a polyol;

wherein the proportion by weight of said poly(methyl vinyl ether-co-maleate) copolymer to said polyol is from about 250:1 to about 3:1 and the weight of said poly(methyl vinyl ether-co-maleate) copolymer plus said polyol per unit weight of said cellulosic fiber, (a), is in the range from about 0.3 to about 2, the poly(methyl vinyl ether-co-maleate) copolymer weight being expressed on an acid equivalent basis.

The following Examples illustrate the formation of polyanionic fibers useful in the practice of this invention.

EXAMPLE VIII

Starting-materials

Acrylic acid (Polysciences Inc., Warrington, Pa.) is vacuum distilled through a Vigreux column and is preferably used fresh in subsequent operations, e.g., within one day of distillation. Itaconic acid (Aldrich Chemical Co., Milwaukee, Wis.) is obtained in 99%+purity and is used as received. The free-radical initiator 2,2'-azobis(2-amidinopropane) dihydrochloride (WAKO V-50, Wako Pure Chemical Industries, Osaka, Japan) is also used as received. Unless otherwise noted, water is triply distilled. Where polymers are dialyzed, the dialysis membrane is obtained from Spectrum Medical Industries, Inc., Los Angeles, Calif.

Polyethylene glycols (these preferred polyols are commonly known as "PEG", various suppliers being suitable) as used in the Examples have nominal molecular weights of 200, 1000, 1500, 3350, and 6800. PEG 200 is obtained from Polysciences Inc., Warrington, Pa. PEG 1000, PEG 1500 and PEG 6800 are obtained from Scientific Polymer Products, Inc., Ontario, N.Y. PEG 3350 is obtained from Sigma Chemical Co., St. Louis, Mo.

Southern softwood Kraft pulp and northern softwood Kraft pulp are obtained from P&G Cellulose, Memphis, Tenn. Chemithermomechanical pulp is obtained from Quesnel Paper Co., Quesnel, B.C, Canada.

Preparation of a Poly(acrylate-co-itaconate) Copolymer Suitable for use in Making a Super-absorbent Fiber (90 Mole % Acrylate, 10 Mole % Itaconate)

Acrylic acid (20.000 g, 0.27755 mole), itaconic acid (4.0121 g, 0.038386 mole), Wako V-50 (0.0837 g, 0.308 millimole), and 150 ml of water which has been acidified to pH 2.0 with hydrochloric acid are added to a 250 ml three-necked round-bottomed flask. The necks are fitted with a thermometer, a stopper, and a gas inlet/-outlet adapter capable of bubbling gas through a liquid in the flask and venting it. The solution is deaerated by passage of nitrogen gas and is then placed under an atmosphere of argon. The solution is heated to 55° C. and is maintained at this temperature for 15 hours. The viscous solution of copolymer is cooled to ambient temperature and is dialyzed overnight against water (Spectrapor 3 tubing with molecular weight cut-off at 3500) to remove any unreacted monomers. The dialyzed solution is freeze dried to afford 23.00 g of poly(acrylate-co-itaconate) copolymer, acid form, as a colorless solid.

Preparation of Fiber

The poly(acrylate-co-itaconate) copolymer (2.00 g) is dissolved by adding it portionwise to 20 ml of water while stirring and heating to 65°-70° C. To the solution is added polyethylene glycol (0.334 g, nominal molecular weight 3350) predissolved in 5 ml of water. Stirring is continued until dissolution is complete. The resulting aqueous medium is cooled to ambient temperature and the pH is adjusted to 3.00 (the "pH of the aqueous medium" referred to elsewhere herein) with Molar sodium hydroxide. Loose fibers of southern softwood Kraft pulp (2.00 g bone-dry weight basis) are added. The resulting slurry is thoroughly mixed and is spread out into a thin layer on a 6-inch diameter watch glass of thickness about 3 mm. The slurry layer is dried in an oven at 65°-70° C., a temperature selected to minimize or avoid crosslinking reactions, and is then cured by placing the watch glass in an oven preheated to a curing temperature of 130° C. The curing time is 11.5 minutes. The layer, now about 1 mm thick, is cooled to ambient temperature. This yields fiber in the acid form, which is not particularly absorbent. The fiber is then repulped. In practice it is convenient to soak it with distilled water, tear it into small pieces and add it to 400 ml of distilled water. After further stirring (e.g., overnight) the pH of the mixture is adjusted to 2.0 with hydrochloric acid and it is mixed in a Waring Blender in two steps wherein (1) the blender is run on low speed for 5.0 minutes at 50% power and (2) the blender is run for 1.0 minute on low speed at full power. The fibers, still in the acid form, are collected by suction filtration in a Buchner funnel fitted with a handsheet forming wire, washed with 400 ml of water, and are re-suspended into 500 ml of water. The slurry pH is adjusted to 8.5 using 1 Molar sodium hydroxide in water. (Using potassium hydroxide or lithium hydroxide instead of sodium hydroxide at this stage would result in the potassium or lithium form of the fibers.) Over two days, the pH is periodically checked and readjusted to 8.5 with sodium hydroxide. During this period, the fibers exchange to the sodium salt form, which is highly absorbent. Thus, the fibers swell. The fully swollen fibers are collected by suction filtration and are washed with distilled water.

EXAMPLE IX

Starting-materials

Poly(methyl vinyl ether-co-maleate) copolymers are obtained from GAF Chemicals Corp., Wayne, N.J. Suitable anhydride forms of the copolymers are GANTREZ AN-149, GANTREZ AN-169, and GANTREZ AN-179, having number average molecular weights, Mn, of 50,000, 67,000 and 80,000, respectively, as identified by GAF. The corresponding acid forms can be obtained by aqueous hydrolysis. A suitable acid-form copolymer directly obtainable commercially from the same supplier is GANTREZ S-97. It can be purchased either as a solid or as an aqueous solution.

Polyethylene glycols (these preferred polyols are commonly known as "PEG", various suppliers being suitable) as used in the Examples have nominal molecular weights of 200, 1000, 1500, 3350, and 6800. PEG 200 is obtained from Polysciences Inc., Warrington, Pa. PEG 1000, PEG 1500 and PEG 6800 are obtained from Scientific Polymer Products, Inc., Ontario, N.Y. PEG 3350 is obtained from Sigma Chemical Co., St. Louis, Mo.

Southern softwood Kraft (SSK) pulp and northern softwood Kraft (NSK), bleached hardwood aspen pulp, bleached hardwood sulfite pulp, cotton linters, bleached hardwood eucalyptus pulp, dissolving SSK (V-60), and mercerized dissolving SSK (V-5), are obtained from P&G Cellulose, Memphis, Tenn. Chemithermomechanical pulp is obtained from Quesnel Paper Co., Quesnel, British Columbia, Canada.

Unless otherwise noted, acetone is reagent grade and water is triply distilled.

Preparation of Fiber

The GANTREZ S-97 (3.35 g) is dissolved by adding it portionwise to 30 ml of water which has been acidified to pH 2.00 with 1 Molar hydrochloric acid while stirring and heating to 65°-70 C. To the solution is added polyethylene glycol (0.500 g, nominal molecular weight 3350). Stirring is continued until dissolution is complete. The resulting aqueous medium is now cooled to ambient temperature. The pH of this medium (the "pH of the aqueous medium" referred to elsewhere herein) is measured to be 1.60. Loose fibers of chemithermomechanical pulp (3.00 g) are added. The resulting slurry is thoroughly mixed and is spread out into a thin layer on a piece of aluminum foil. The slurry layer is dried in an oven at 65°-70° C., a temperature selected to minimize or avoid crosslinking reactions. The layer, now about 1 mm thick, is removed from the foil and is cured by placing it in an oven preheated to a curing temperature of 130° C. The curing time is 6.5 minutes. The layer is cooled to ambient temperature. This yields raw fiber in the acid form, which is not particularly absorbent. The fiber is then repulped. In practice it is convenient to break it into small pieces and add it to 500 ml of distilled water. After further stirring (e.g., 1 hour) the pH of the mixture is adjusted to 2.0 with hydrochloric acid and it is mixed in a Waring Blender for 1 minute on low speed. The fibers, still in the acid form, are collected by suction filtration in a Buchner funnel fitted with a handsheet forming wire, are washed with 500 ml of water, and are re-suspended into 500 ml of water. The slurry pH is adjusted to 8.5 using 1 Molar sodium hydroxide in water. (Using potassium hydroxide or lithium hydroxide instead of sodium hydroxide at this stage would result in the potassium or lithium form of the fibers.) Over one day, the pH is periodically checked and readjusted to 8.5 with sodium hydroxide. During this period, the fibers exchange to the sodium salt form, which is highly absorbent. Thus, the fibers swell. The fully swollen fibers are collected by suction filtration and are washed with distilled water.

Incorporation of super-absorbents of the foregoing type into paper sheets, and the like, having good wet-strength and ultra-high absorbency is carried out in the following manner.

EXAMPLE X

Preparation of Superabsorbent Layered Handsheet Paper

Two separate slurries are prepared comprising 1.06 g (1.0 g dry wt.) 40% wt. unrefined NSK pulp in 250 ml distilled water, adjusted to pH 8.5 (0.1N sodium hydroxide).

The polycationic latex of Example I is added to each of the two NSK/water slurries and stirred for 30 minutes.

The superabsorbent fiber of Example VIII (0.5 g dry wt.) is slurried in 150 ml distilled water at pH 8.5 (1.0N sodium hydroxide).

Each separate slurry is formed on the Deckle Box in distilled water at pH 8.5 and placed on a transfer fabric in the following order: top layer, NSK sheet; middle layer, superabsorbent sheet; bottom layer, NSK sheet.

Each layered sheet is transferred via a vacuum slit to a transfer sheet to form the finished paper handsheet. The finished handsheet is passed over a high vacuum twice and a second transfer sheet is placed on top of the finished sheet. The resulting sheets are passed over the drum dryer (155° C.) 10-12 times, until dry.

EXAMPLE XI

Mixed Furnish Handsheet Paper Containing Superabsorbent Fibers 2.0 g dry wt. unrefined NSK pulp is dispersed in 35.0 ml distilled water at pH 8.5 (0.1N sodium hydroxide). 3.0% (1.304 g) of the polycationic latex of Example I is added to the NSK pulp dispersion and stirred for 30 minutes.

Separately, a dispersion is prepared comprising 20% of the superabsorbent fibers according to Example IX and 150 ml distilled water at pH 8.5 (1.0N sodium hydroxide).

The two slurries prepared in the foregoing manner are then combined and stirred for 15 minutes.

Following the procedure in Example VI, the handsheet is formed on the Deckle Box with distilled water at pH 8.5 (1.0N sodium hydroxide). The handsheet is dried between two transfer fabrics on the drum dryer (115° C.) using 10-12 passes to achieve dryness.

EXAMPLE XI

While the Examples above illustrate the formation of polycationic latexes useful herein, it will be appreciated that the styrene/1,3-butadiene monomers used in Example I can be replaced by, for example: styrene/isoprene (1:1 wt.); isoprene; and ethylene, respectively. Such examples are given here by way of illustration and not limitation.

EXAMPLE XIII

Paper containers such as bags, boxes, packages, and the like are prepared from the treated paper made according to the practice of this invention using conventional folding and processing technology. The resulting containers exhibit excellent wet strength.

What is claimed is:

1. A paper sheet comprising multiple cellulosic fibers and a water-insoluble polycationic latex wet strength agent which is the reaction product of i) a cationic polyamide/polyamine/epichlorohydrin wet strength resin containing repeat units of the general structural type

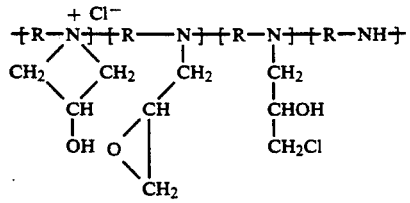

wherein R is

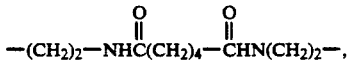

and ii) an unsaturated carboxylate reactant selected from the group consisting of acrylic acid, methacrylic acid, glycidyl methacrylate, and mixtures thereof, said reaction product being co-polymerized via its point of unsaturation from said carboxylate reactant with latex-forming polymerizable monomers or oligomers selected from the group consisting of styrene, 1,3-butadiene, and mixtures thereof.

2. A sheet according to claim 1, wherein said wet-strength agent comprises from about 1% to about 30% by weight of said paper sheet.

3. A paper sheet according to claim 1 additionally comprising absorbent gelling material.

* * * * *